United States Patent [19]

Smith

[11] Patent Number: 5,005,869

[45] Date of Patent: Apr. 9, 1991

[54] DEVICE TO DISPLAY COVER AND PAGES OF A DOCUMENT

[76] Inventor: Samuel C. Smith, 210 Hartman Rd., Newton Center, Mass. 02159

[21] Appl. No.: 529,779

[22] Filed: May 25, 1990

Related U.S. Application Data

[63] Continuation of Ser. No. 173,599, Mar. 25, 1988, abandoned.

[51] Int. Cl.[5] ..... B42D 1/00; B42D 3/00; A47B 91/00; A47G 1/06

[52] U.S. Cl. ..... 281/15.1; 281/45; 248/349; 40/152.1

[58] Field of Search ..... 281/15.1, 32, 33, 45, 281/48; 248/349; 40/152.1

[56] References Cited

U.S. PATENT DOCUMENTS

| | | | |
|---|---|---|---|
| 517,803 | 4/1894 | Howard | 281/45 |
| 700,803 | 5/1902 | Orlansky | 281/45 |
| 1,436,544 | 11/1922 | Starr | 248/349 |
| 2,631,589 | 3/1953 | Zalkino | 40/359 |
| 3,056,506 | 10/1962 | Fuller et al. | 248/349 |
| 3,166,342 | 1/1965 | Yerkes | 281/33 |
| 4,202,121 | 5/1980 | Maris et al. | 40/152.1 |
| 4,279,086 | 7/1981 | Phillips | 40/152.1 |
| 4,707,937 | 11/1987 | Astolfi | 40/152.1 |

FOREIGN PATENT DOCUMENTS

| | | | |
|---|---|---|---|
| 78375 | 11/1954 | Denmark | 281/33 |
| 608 | of 1855 | United Kingdom | 281/48 |
| 11068 | of 1893 | United Kingdom | 281/32 |

*Primary Examiner*—Douglas D. Watts
*Assistant Examiner*—Paul M. Heyrana, Sr.
*Attorney, Agent, or Firm*—Jerry Cohen; Harvey Kaye

[57] ABSTRACT

The present application discloses a book form picture or document holder. It consists of a pair of binder covers the front of which is a picture frame and the back a rigid flat which includes support and artwork. A length of thread that is nearly invisible links a plurality of pages in a manner that avoids page by page turning when in use. An automatic method of display of successive pages of a document using this invention is also disclosed and would be of use in document displays.

10 Claims, 3 Drawing Sheets

DEVICE TO DISPLAY COVER AND PAGES OF A DOCUMENT

This is a continuation of application Ser. No. 173,599, filed Mar. 25, 1988 abandoned May 25, 1990.

FIELD OF THE INVENTION

This invention refers to a display device and a method to fan pages of a book, either by hand or automatically, in a manner that a frame type cover and the pages of the document are available for view.

BACKGROUND OF THE INVENTION

The present invention relates to picture and certificate frameworks for wall and desk display but more particularly to framed works for wall and desk which in addition to exhibiting a picture or certificate, hold pages of the contents which have a memorable characteristic.

Generally only the face of a framed patent or other multipage document is accessible for easy viewing. Mainly for this reason, a replica of the patent and not the patent itself is usually framed and the original patent is reserved for other necessary usage. The special cover of the 1987 U.S. Patent sparked the thought of providing for the framing of the original patent while at the same time imposing no restriction on viewing the related pages. The same concept would apply to other documents of sentimental value.

A computer search at the Boston Public Library produced no substantial items of pertinence to the frame/book device. The automatic viewing is a concept that utilizes a state of the art product (a turntable) modified to accomplish a particular need. Insofar as I am aware, there is nothing to suggest the features disclosed and claimed herein.

DESCRIPTION OF THE INVENTION

It is accordingly an object of the present invention to enhance a document that has a sentimental or special character and which has more than two pages.

A more general object of this invention is to make a multipage document on display more accessible for viewing.

It is also an object of the invention to provide varied ways to display multipage documents and to carry and handle them safely.

This invention also helps to stimulate self satisfaction more than would be possible with a partial display of a multipage document by allowing the viewer to see the document bound in its entirety. This invention will provide an appropriate holder for a unique document depicting a memorable occasion such as the 1987 U.S. Patent cover and its contents.

The foregoing objects are achieved in accordance with the present invention by a combination of a frame, book type bindings and an attachment means that allows viewing of the documents and interconnects the pages of the document to aid in review. According to a feature of the invention, the front cover has the appearance of a picture or certificate frame to present the full view of the face of the document on wall and desk display positions (or when closed). The back cover includes means of propping the frame and contents at a viewing angle or wall hanging devices and also includes artwork depicting the particular occasion. According to another feature of the invention, each page contains a thin flat strip of clear plastic fastened on the back side.

These strips are linked by a length of thread in a manner that provides pulling at one point only to effect readable view of successive pages. In accordance with a related feature, a rotatable device or turntable is used to provide the necessary pull for the page turning.

The foregoing objects and features, together with the advantages of the present invention, will be better understood from the detailed description of the drawings and the preferred embodiment.

DESCRIPTION OF DRAWINGS

FIG. 5A is a detail, partial top view (partly sectioned) of a leaf (page) element of the embodiments of FIG. 6.

PREFERRED EMBODIMENT OF INVENTION

This invention and method disclosed herein for display of documents has been in experimentation within the applicants facility for a considerable time. The materials and methods of assembly have been varied over this time and at times there have been variations. The method described herein is the preferred method known to the inventor at the time of filing. In this description the terms used in the description draw their meaning from the specification and should be used in the specific meaning herein if a question between a broad and a specific meaning arises.

The invention in its first most preferred embodiment was made using a metal edged picture frame purchased at a large chain discount store. These frames are common in the retail trade. The document front was centered in the frame and the frame back was put in place.

Figure 1:
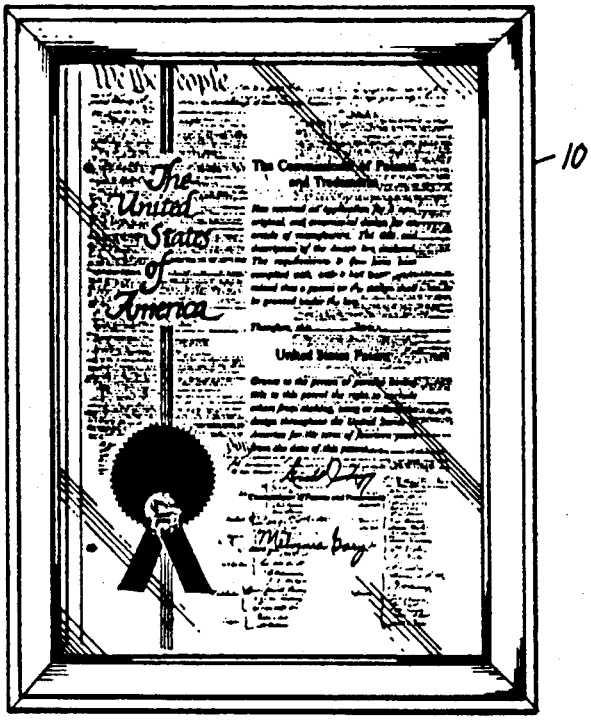
FIG. 1 is a view, as seen from the front, of a picture frame containing a document according to the present invention.
Figure 2:
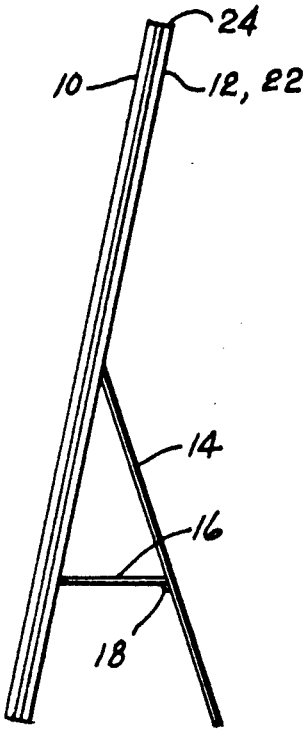
FIG. 2 is a side view—in desk sitting position—of the invention showing a propping flap and a securer common to display frames according to the present invention.
Figure 3:
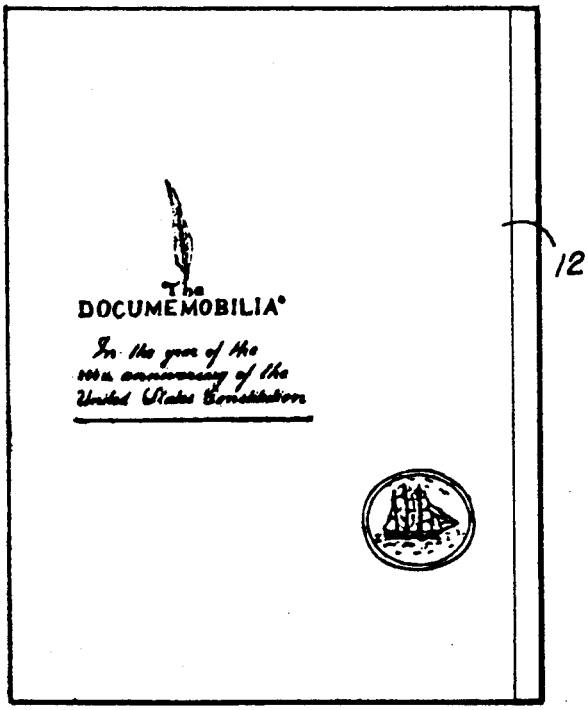
FIG. 3 is a view in front elevation of the back cover and showing a typical artwork design according to the present invention.
Figure 4:
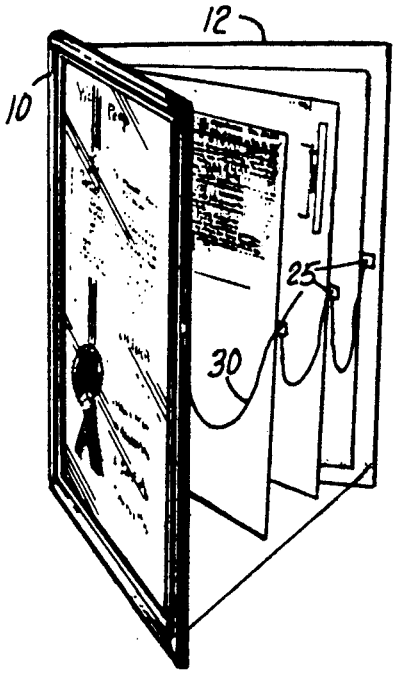
FIG. 4 is a pictorial view as seen from the front of a book type binder in opening position and depicting an elastomer band purported to retract the frame for repeating cycle according to the present invention.
Figure 7:
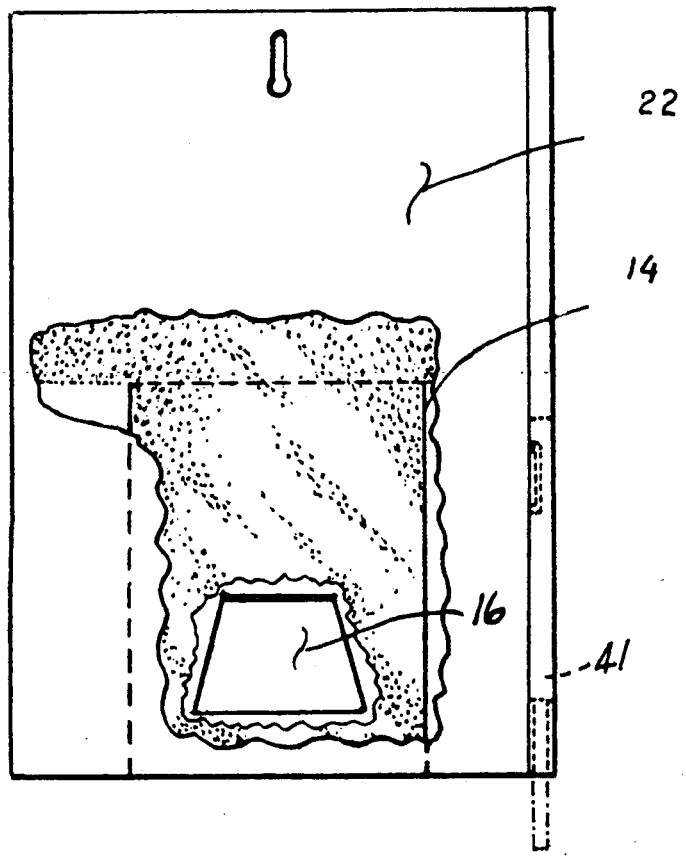
FIG. 7 is another view in front elevation of the back cover and showing the propping flap and its securer of FIG. 2 through respective cutaway sections.

A back plate was fabricated from cardboard and printed with designs and artwork to make it relate to the document and to add to the appearance of the display. The back had projecting means for the hanging of the display on a wall in the form of a thin brass plate with a upside down keyhole shape cut into it at the top. Provision for desk display is best accomplished by cutting a section of the back cover 12 on two sides at the lower end starting at the base edge and terminating at approximately half way up the frame height and then proceed as if to cut away the section by cutting across the top extreme of the lines except that the cutting is done on the reverse side of the back cover and the cutting stops short of penetrating the other side (or face) of the back cover 12. It is desirable to try pulling the lower part of the flap as a trial during the course of the partial cut. This would insure proper hinge action. The hinge is made ready after placing a fabric or equivalent binding tape over the cut. The tape placement is done at the maximum outward or active position of the flap. The flap securer 16 is provided in the same manner as the flap 14. FIGS. 2 and 7 illustrate the finished product. When closed, the flap position fits well along the cut. Moreover a late development resulted in an enhancement of the back cover. In this development, an artwork cover 22 covers the entire surface of the back cover 12 and is thereon bonded except for the surfaces on the sides of the flap 14. These surfaces are free of bonding agent. Thus, the existance of the flap is not obvious when the flap is in the closed position. Velcro or other fastenings may also be used to close the flap. A cutaway section of the artwork cover 22 and another cutaway section of flap 14 illustrate the flap and flap securer respectively in FIG. 7.

A flat strip of water clear acryllic plastic 26 is fastened on the reverse side (back) of each sheet of the document. The strip is placed horizontally in or near the center of the document sheet 28 with one end slightly projecting from the edge of the sheet. A hole 25 approximately 1/32nd of an inch in diameter is drilled in or near the center of the projecting portion of the plastic strip. All of the clear plastic strips are of the same dimensions and drilled at the same place in each such that the holes are in alignment. A separate set of sheets are attached to each other the succeeding sets of strips are longer than the preceeding set by a small amount, typically 1/32nd of an inch. One plastic strip is used for each sheet. A length of plastic thread 30 that is nearly invisible to the unaided eye is used to link the sheets. The linkage is made by threading the thread through the holes in the projections of the plastic strips. The spacing between the sheets and the point where they would start to open was controlled by adding knots 52, 54 in the thread between each plastic strip, the location of said knots being a controller of the point where force will be applied to open or close the sheet. Alternates to the knots were glues and a loop through the hole, around the end of the plastic strip, and back through the hole. A wide variety of means to open the sheets other than knots is possible.

Figure 5:
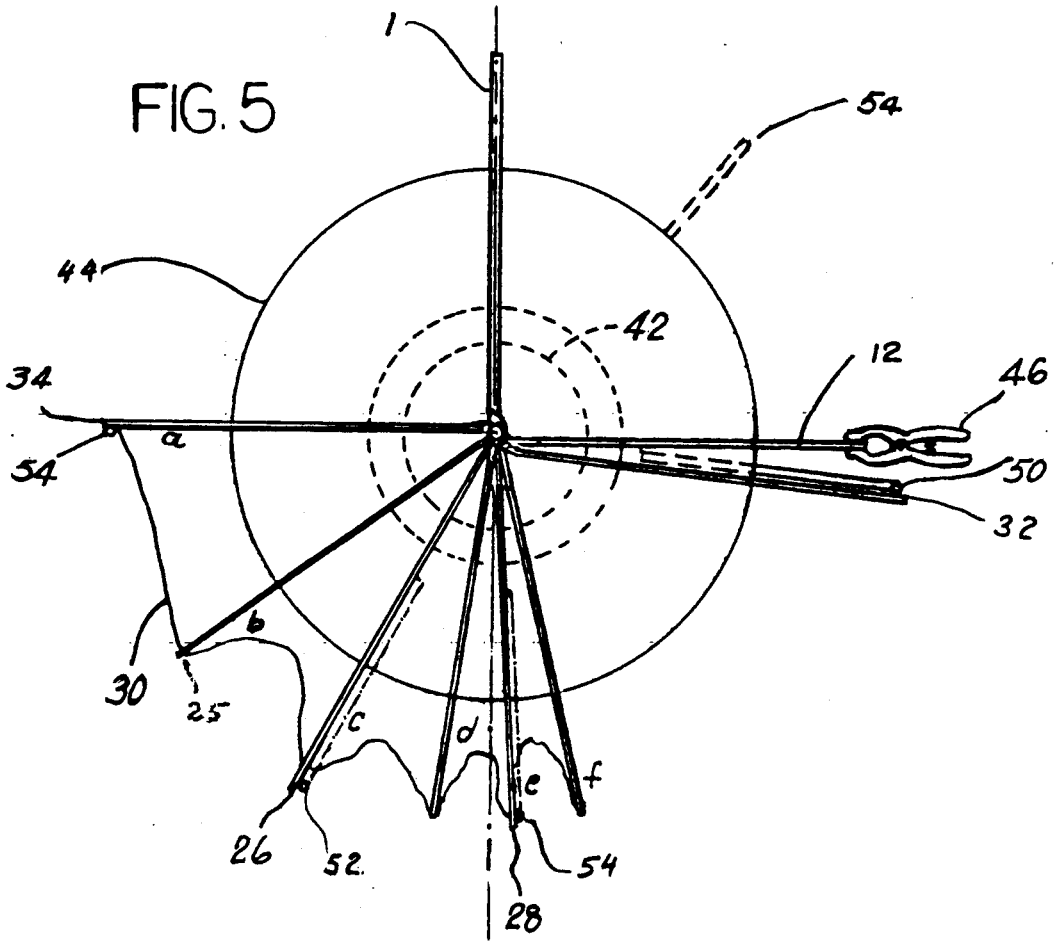
FIG. 5 is a view as seen from the top of the opening position of the device and depicts the rotational arrangement as it effects page turning according to the present invention.

Any number of sheets can be strung together in this manner. For the best viewing, it is preferred that no more than 5 sheets are commonly linked. Thus, the best way to link a 15 sheet document is with three 5 sheet threaded together linkages. In FIGS. 5 and 2 sets of common linkages are shown. Note that while each set of plastic strips has the holes aligned, it is often best to have each set of strips displaced from another set such that they do not interfere with each other. It is for this reason that the strips are close to the center of each sheet but are not restricted to the exact center. It is also important for proper operation in some modes of use that, while the holes are all at the same location in relation to the sheets, the extension length projecting from the sheet may be progressively longer for each set. The reason for this is discussed later with mechanical turning devices.

Each set of five or so sheets is separate and would have to be turned by hand or by automatic means but it is also possible to link between sets with another thread.

The final assembly in this the most preferred embodiment is by commonly known book binding method, frame, document and back cover are firmly attached so that the final product has the appearance of a book but with its pages interconnected by the thread permitting them to fan open when the book is fully opened. Fully opened in this case means more than 270 degrees included angle between the front frame and back cover.

It is also possible to add a glued tape to the back of the frame that is the front of this invention and a similar tape to the back plate and to use commonly known book binding methods to bind just the sheets and the plastic strips together. The tape is then firmly affixed to the bound sheets and plastic strip package to attach the front frame as a cover for this display and to similarly attach the back plate to the rear of the strips and sheets bound together so that the final product looks like a book but has sheets interconnected by the thread attached to the plastic strips so they fan open when the book is fully opened.

In a last embodiment, the device in the first and most preferred embodiment was modified such that the binding was attached by an adhesive to a shaft and the back plate was fixed in a permanent position and the frame was supplied with a downward pin extension that interfaced with a drive motor having a slow clockwise motion. In this embodiment the frame portion traced an arc and the sheets forming the pages fanned open and then closed like a series of turned pages in a book. This device allowed a continuous view of the pages turning.

Figure 6:
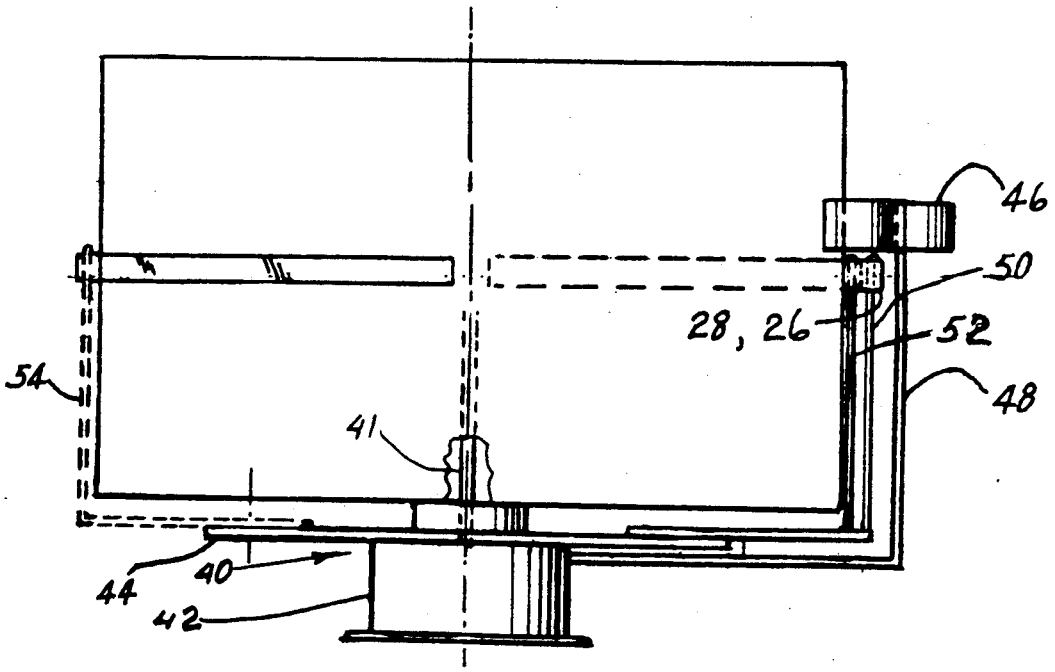
FIG. 6 shows the automatic display mode of this invention whose base encloses a motor that rotates a shaft in a clockwise direction—in this case—but can be in both directions. Thus, rotating the frame and document pages in a manner that shows each page in succession and the back cover according to the present invention.

FIGS. 5 and 6 illustrate the automatic viewing device 40 and the method of operation.

The book assembly having a shaft 41 attached thereto is positioned on viewing device 40. Shaft 41 thereby slides through a center hole and connects with a drive motor inside base 42. The back cover 12 is held stationary by means of a clamp 46 which is linked to a bracket 48 which in turn is fastened to base 42. The frame (front cover) 10, by means of a clear plastic strip attached to the first sheet of document 24, which is linked to frame 10, can make contact with another driver 52 which is fastened to turntable tray 44. For simplicity, FIGS. 5 and 6 serve to clarify aforementioned method of application where the alignment of successive groups of strips was covered.

In operation, as the turntable tray 44 slowly turns clockwise, driver 50 makes contact with extended clear plastic strip 26 and moves clear of clamp 46 and bracket 48 makes contact with clear plastic strip 26 and moves clear of clamp 46 and bracket 48. As rotation takes place, the first and second pages come into view followed by the third and fourth. At a time t, after 4 pages have been fully exposed, a second driver 52 makes contact with clear plastic strip 34 which is attached to page 5, thereby exposing pages 5 to 8. Meanwhile, the first set (pages 1–4) continues on until frame 10 reaches a stop 54. At that point, the second—followed by the third—closes the set ahead as rotation continues. A requirement is to have succeeding leading strips 26, 28, etc progressively shorter to avoid interference. Note here 26*c* and 28*e* of FIG. 5. The book pages, exclusive of front and back covers, are (1) and (2) on front and back of leaf (a), (3) and (4) on front and back of leaf (b), etc.

At the end of the cycle, the document closes and the cycle repeats. One way of closing is to space the frame and the back cover with an elastic band means and to switch off power to the driver. Another way is to allow rotation to continue as book front is released and closes. Still another is the use of an oscillating turntable.

The number of sheets that can be accomodated by the present invention depends on the nature of the page contents. In general, optimum results require 60 degrees included angle between 2 sheets. This provides good viewing for a fully covered page.

While the device can handle up to 5 lbs, a mere finger touch which acts as a brake at any point on the tray 44 will stop turning so that viewer can spend time as required.

Stop 54 is a simple extended bar having one end attached to base 42 and the other positioned for the resting of the frame. The surface of the bar where contact is made with the frame should have a scratch protection lining or cover.

Figure 8:
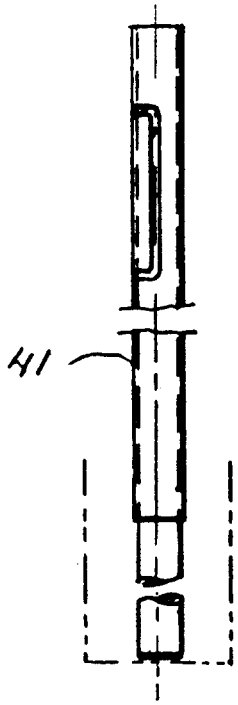
FIG. 8 is a view as seen from the front of a telescopic (or retractable) shaft according to the present invention.

FIG. 8 shows a telescopic shaft which when not using turntable allows the collapsing of the shaft projection when not in use. The shaft does not protrude beyond the base of the book assembly but when needed, a simple twist, pull and twist motion exposes the shaft for use in the turntable. This is accomplished by providing a U-slot on the sleeve and a pin on the rod to ride in the slot.

The foregoing describes preferred embodiments of the present invention but appropriate variations may be effected within the scope of the present invention.

I claim:

1. A device for substantially vertical (i.e., non-horizontal) display of a book form memorable document with three or more leaves in a series, a first such leaf being a front cover member with primary display significance, the device comprising in combination:

(a) means forming a common pivot/binder for the leaves at a common first side edge of each leaf which allows variable spread openings of the leaves to be established and maintained;

(b) each of several of the leaves comprising a display page with a coupled rigid member;

(c) means forming a lost motion pull linkage between successive leaves and comprising a thread passing through openings at a second (outer) side edge of such leaf with stops spaced along the thread with sufficient slack to allow up to a maximum spread between successive leaves, the stops being effective in engaging openings - while the thread is pulled - to impart turning motion to the leaf carrying the engaged opening.

2. The device of claim 1 wherein each rigid member is a transparent narrow strip of less than full page height and including a portion at the second leaf edges for engaging the thread.

3. The device of claim 2 wherein the right member of each leaf in a progressive rotation series extends further out than the next succeeding one and further comprising:

(d) series driving means for the thus staggered edges.

4. The device defined in claim 1, wherein the said first page is mounted decoratively in a frame.

5. The device as defined in claim 4, wherein there is a back plate, the said back plate being provided with decoration and means to hang the device on a wall.

6. The device as defined in claim 1, wherein there is a back plate, the said back plate being provided with decoration and means to display the device in a substantially upright position.

7. The device as defined in claim 1, wherein the plastic sheets are narrow strips and the openings are small holes in said narrow strips through which said thread may travel and restraining means to restrict the amount of travel.

8. The device in claim 7 where the restraining means is a knot.

9. The device as defined in claim 7, wherein the restraining means is a projection from said thread.

10. The device as defined in claim 9, wherein the said cover is attached to a shaft which projects from the said cover and serves as an axis for the rotation, the said shaft telescopes by a telescoping means such that when the shaft is not needed it will not project beyond said cover.

* * * * *